US009945206B2

(12) United States Patent
Zhou

(10) Patent No.: US 9,945,206 B2
(45) Date of Patent: Apr. 17, 2018

(54) STAGE CEMENTING TOOL AND METHOD

(71) Applicant: Saudi Arabian Oil Company, Dhahran (SA)

(72) Inventor: Shaohua Zhou, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 177 days.

(21) Appl. No.: 14/952,721

(22) Filed: Nov. 25, 2015

(65) Prior Publication Data

US 2017/0145784 A1 May 25, 2017

(51) Int. Cl.

| | |
|---|---|
| ***E21B 33/14*** | (2006.01) |
| ***E21B 33/128*** | (2006.01) |
| ***E21B 34/10*** | (2006.01) |
| *E21B 34/00* | (2006.01) |

(52) U.S. Cl.

CPC ..... *E21B 33/146* (2013.01); *E21B 33/128* (2013.01); *E21B 33/1285* (2013.01); *E21B 34/10* (2013.01); *E21B 2034/007* (2013.01)

(58) Field of Classification Search

CPC .. E21B 33/146; E21B 33/128; E21B 33/1285; E21B 34/10; E21B 2034/007

See application file for complete search history.

(56) References Cited

U.S. PATENT DOCUMENTS

| | | | | |
|---|---|---|---|---|
| 5,279,370 | A | 1/1994 | Brandell | |
| 5,443,124 | A | 8/1995 | Wood et al. | |
| 5,711,372 | A | 1/1998 | Stokley | |
| 6,164,378 | A | 12/2000 | Coronado | |
| 6,651,743 | B2 | 11/2003 | Szarka | |
| 6,695,067 | B2 * | 2/2004 | Johnson | E21B 33/128 166/195 |
| 6,820,697 | B1 | 11/2004 | Churchill | |
| 7,857,052 | B2 | 12/2010 | Giroux et al. | |
| 8,720,561 | B2 | 5/2014 | Zhou | |
| 8,800,655 | B1 | 8/2014 | Bailey | |
| 2003/0075342 | A1 | 4/2003 | Gunnarsson | |
| 2012/0241154 | A1 * | 9/2012 | Zhou | E21B 33/146 166/285 |

(Continued)

OTHER PUBLICATIONS

International Search Report and Written Opinion issued in International Application No. PCT/US2016/029796 dated Aug. 2, 2016.

*Primary Examiner* — D. Andrews
*Assistant Examiner* — Yanick A Akaragwe
(74) *Attorney, Agent, or Firm* — Fish & Richardson P.C.

(57) ABSTRACT

A well tool for use in completing a wellbore includes a tubular housing having a central bore and a housing port through a wall of the tubular housing, an inner mandrel disposed within the tubular housing and selectively movable between a first, closed position and a second, open position in response to a fluid pressure in the central bore, a sealing element circumscribing a portion of the tubular housing, and a setting sleeve. The inner mandrel is configured to open the housing port when the inner mandrel is in the second, open position. The setting sleeve is movable between a first, retracted position and a second, expanded position, where the setting sleeve is configured to activate the sealing element in the second, expanded position in response to movement of the inner mandrel to the second, open position.

19 Claims, 8 Drawing Sheets

(56) References Cited

U.S. PATENT DOCUMENTS

| | | | | |
|---|---|---|---|---|
| 2012/0261127 | A1 | 10/2012 | Zhou | |
| 2016/0177658 | A1* | 6/2016 | Lee | E21B 33/1285 166/305.1 |
| 2016/0230505 | A1* | 8/2016 | Garcia | E21B 23/01 |

* cited by examiner

STAGE CEMENTING TOOL AND METHOD

TECHNICAL FIELD

This disclosure relates to well tools for use in completing a wellbore, and more particularly to stage cementing well tools.

BACKGROUND

Stage cementing is used in well operations to form cased and cemented wellbores in stages. A stage cementing well tool operates to supply cement to an annulus of a wellbore at a location within a wellbore above a bottomhole assembly. For example, stage cementing well tools can be utilized when a single stage cement process is faulty, incomplete, or otherwise unsatisfactory and requires additional cement to form a cemented casing. Sometimes, a stage cementing well tool disposed in a well includes a packer element and cementing ports to flow cement into an annulus of the well.

SUMMARY

This disclosure describes stage cementing tools and methods in wellbore cementing.

Certain aspects encompass a well tool for use in completing a wellbore. The well tool includes a tubular housing including a central bore and a housing port through a wall of the tubular housing, an inner mandrel disposed within the tubular housing and selectively movable between a first, closed position and a second, open position in response to a fluid pressure in the central bore, a sealing element circumscribing a portion of the tubular housing, and a setting sleeve movable between a first, retracted position and a second, expanded position. The inner mandrel is configured to open the housing port when the inner mandrel is in the second, open position. The setting sleeve is configured to activate the sealing element in the second, expanded position in response to movement of the inner mandrel to the second, open position.

The aspects above can include some, none, or all of the following features. The well tool can include a biasing element between the inner mandrel and the tubular housing to bias the inner mandrel toward the first, closed position. The inner mandrel can include a passage through a wall of the inner mandrel, and the passage can be alignable with the housing port when the inner mandrel is in the second, open position. The tubular housing can include a fluid pressure chamber fluidly coupled to the central bore by a fluid inlet port, and a surface of the inner mandrel contacts a fluid in an interior of the fluid pressure chamber. The inner mandrel can be configured to move in response to hydraulic pressure of the fluid in the fluid pressure chamber acting on the surface of the inner mandrel. The well tool can include a filter disposed in the fluid inlet port. The inner mandrel can include a tool locking profile defined in an inner surface of the inner mandrel that faces the central bore, where the tool locking profile is configured to engage an operating tool. The central bore can be free from a plug seat along a longitudinal length of the well tool. The central bore can include a full-bore pass through along an entire longitudinal length of the well tool. The well tool can include a locking mechanism disposed between the tubular housing and the setting sleeve, the locking mechanism configured to lock the setting sleeve in the second, expanded position. The well tool can include a fluid in an isolated fluid chamber disposed within the tubular housing, wherein the fluid contacts a surface of the inner mandrel about a first end of the isolated fluid chamber and a surface of the setting sleeve about a second end of the isolated fluid chamber, and movement of the inner mandrel to the second, open position pressurizes the fluid to move the setting sleeve to the second, expanded position. The sealing element can include a packer element. The packer element can include at least one of a mechanical packer, a swellable packer, or an inflatable packer.

Certain aspects encompass a method including receiving a fluid pressure greater than a threshold fluid pressure from a central bore of a well tool on an inner mandrel of the well tool, where the well tool includes a tubular housing, the inner mandrel disposed within the tubular housing, a sealing element circumscribing a portion of the tubular housing, and a setting sleeve. The method further includes moving, in response to receiving a fluid pressure greater than a threshold fluid pressure, the inner mandrel from a first, closed position to a second, open position, opening, with the inner mandrel in the second, open position, a housing port through a wall of the tubular housing to fluidly couple the central bore and an exterior of the well tool, and moving, in response to moving the inner mandrel from the first, closed position to the second, open position, the setting sleeve from a first, retracted position to a second, expanded position to activate the sealing element.

The aspects above can include some, none, or all of the following features. The method can include receiving a fluid pressure less than the threshold fluid pressure from the central bore of the well tool, and returning the inner mandrel to the first, closed position. Returning the inner mandrel to the first, closed position can include biasing the inner mandrel toward the first, closed position with a biasing spring, where a spring force of the biasing spring acting on the inner mandrel is substantially equal to the threshold fluid pressure. The sealing element can include a packer element, and the method can include setting the packer element in response to movement of the setting sleeve to the second, expanded position. The packer element can include a mechanical packer, and setting the packer element can include extruding the mechanical packer to an expanded configuration. The method can include locking the setting sleeve in the second, expanded position. The method can include maintaining a fluid pressure in the central bore above the threshold fluid pressure, and pumping cement from within the central bore out of the well tool through the housing port.

Certain aspects can include a stage cementing well tool including a tubular housing having a central bore and a housing port through a wall of the tubular housing, an inner mandrel disposed within the tubular housing and selectively movable between a first, closed position and a second, open position, a biasing element between the inner mandrel and the tubular housing to bias the inner mandrel in a first direction toward the first, closed position, and a fluid pressure chamber fluidly coupled to a fluid in the central bore. The inner mandrel includes a passage through a wall of the inner mandrel, the passage being alignable with the housing port when the inner mandrel is in the second, open position. The fluid pressure chamber is defined by a surface of the tubular housing and a surface of the inner mandrel. The fluid in an interior of the fluid pressure chamber applies a hydraulic force on the surface of the inner mandrel in a second, opposite direction toward the second, open position.

The details of one or more implementations of the subject matter described in this disclosure are set forth in the accompanying drawings and the description below. Other features, aspects, and advantages of the subject matter will become apparent from the description, the drawings, and the claims.

DETAILED DESCRIPTION

Figure 1:
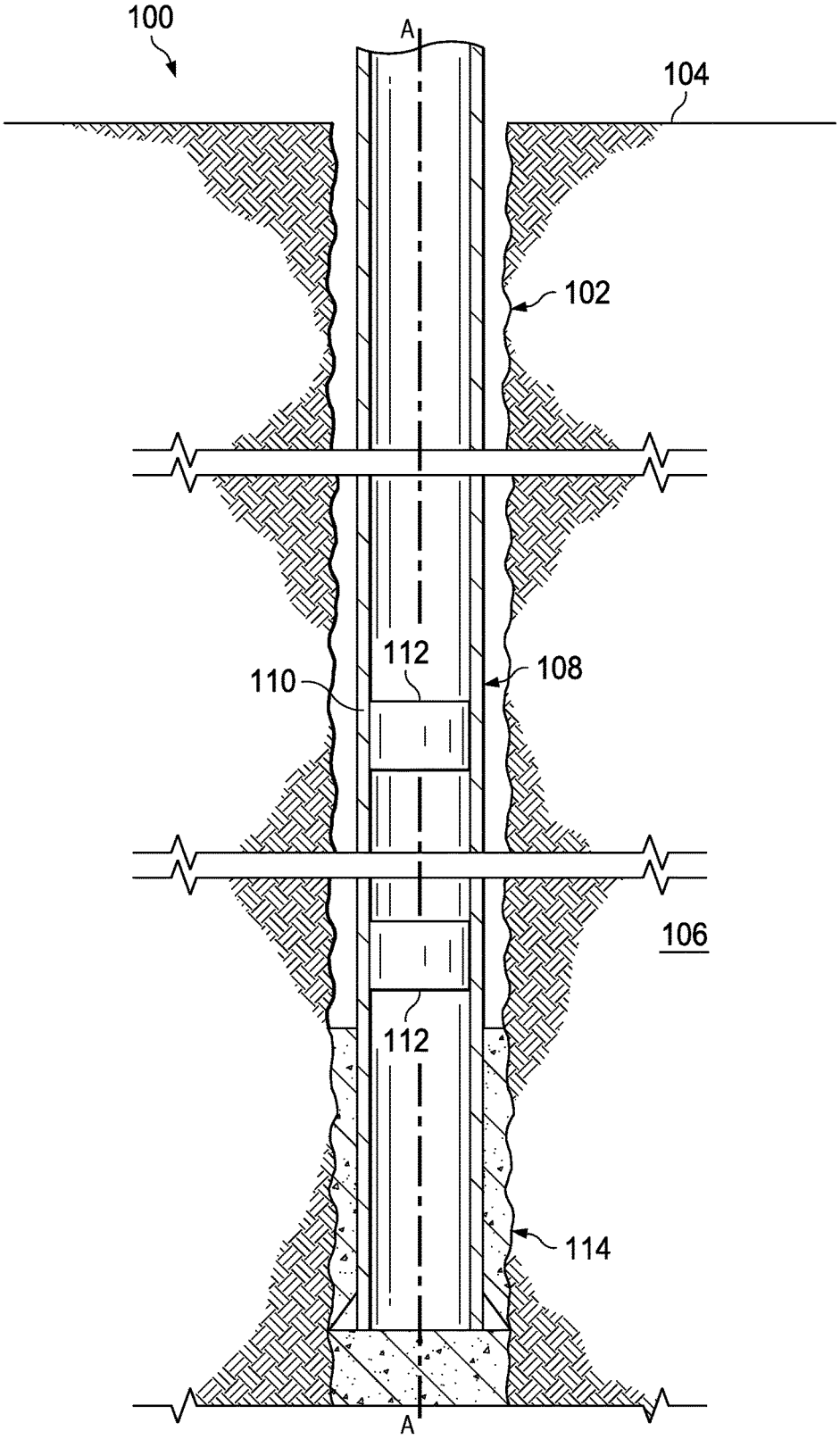
FIG. 1 is a schematic partial cross-sectional view of an example well system.

This disclosure describes a stage cementing well tool that selectively opens and closes flow ports that fluidly connect a central bore of the stage cementing well tool and an exterior of the well tool. With the well tool disposed in a wellbore, the flow ports can be selectively controlled (e.g., opened and closed) to allow the flow of fluid (e.g., cement, slurry, and/or other) from the central bore of the well tool out to the exterior of the well tool, for example, to form a casing in the wellbore. The opening and closing of the flow ports can be controlled in response to fluid pressure (e.g., hydraulic pressure) within the central bore of the well tool, or an operating tool to manually open the flow ports. For example, a work string fluidly coupled to the central bore of the well tool can be pressured up to open the flow ports in the well tool and allow cement, concrete slurry, or other fluid fed through the work string to disperse into the well annulus through the open flow ports. When the stage cement, concrete slurry, or other fluid is completely exhausted from the flow ports, the central bore pressure can be decreased (e.g., at the well surface) to close the flow ports in the well tool. The stage cementing well tool can include a full-bore pass through, for example, free from plug seats or other obstructions that reduce or otherwise obstruct a diameter of the central bore of the well tool. In some implementations, the stage cementing well tool includes a sealing element (e.g., packer element, such as a mechanical packer, inflatable packer, swellable packer, and/or other) that can be set in response to the same fluid pressure or operating tool used to selectively open the flow ports.

In some conventional stage cementing well tools, a plug seat along the central bore of the well tool is required to seal with a plug (e.g., dropped ball or landing/opening plug) in order to hydraulically activate some element of the conventional stage cementing well tool, such as a packer setting element or flow port element. This disclosure describes a stage cementing well tool with a mandrel that is movable to open flow ports in response to pressure within the central bore of the well tool. In some implementations, the stage cementing well tool has a full-bore pass through, for example, where the central bore is free from plug seats or other obstructions along the longitudinal length of the well tool. In such implementations, there are no plugs or plug seats to drill out after a stage cementing operation using the stage cementing well tool. Further, the stage cementing well tool can hydraulically open and close flow ports without the use of a plug and plug seat within the central bore of the well tool. In certain implementations, operation of the stage cementing well tool to selectively control the flow ports and/or set a packer element is not affected by the wellbore angle or deviation of the wellbore in which the well tool is disposed. For example, since a drop plug does not need to be used to actuate the well tool, operation of the well tool is not dependent on a drop plug having to engage a plug seat of the well tool at a specific angle of the well tool in the wellbore. In some implementations, a sealing element (e.g., packer element) of the stage cementing well tool can be tested after it is set.

In some implementations, a stage cementing well tool of this disclosure allows for a mechanical option of operating (e.g., moving) the mandrel, for example, using a dedicated operating tool or setting tool. This mechanical option can effectively deal with the potential situation that casing float equipment on a bottom section of a well string fails to maintain casing pressure integrity, for example, during a first stage cementing operation. In some implementations, the stage cementing well tool design of this disclosure provides the advantage of a full-bore pass through where no drill-out operation is required, where conventional stage cementing tools do require this drill-out operation. Because of this, stage cementing well tools of the present disclosure provide little to no risk of potentially damaging or causing a leak point across the stage cementing tool from drill-out procedures of plugs and/or plug seats, as compared to these risks being present in conventional stage cementing tools and primary-stage cementing tools. In certain implementations, a full-bore pass through of stage cementing tools better facilitates run-in of multiple stage cementing tools in a casing string, for example, to effectively and efficiently deal with loss zones in an open-hole section for the purpose of achieving better well integrity (e.g., as each stage cementing tool can be individually operated by a dedicated setting tool on an inner work string or its own threshold activation pressure). In some example conventional stage cementing operations, two conventional stage cementing tools can be used in one casing string, but due to landing plug seat size constraints and four plugs required to operate the two conventional tools (two for each tool), an incorrect or out-of-sequence landing/opening plug can be deployed, which can lead to very serious cementing problems with a major well integrity concern, and remedial operation would be required. Cementing casing is an important operation in well construction, and in some instances, cementing casing is a one-shot opportunity where if something goes wrong, the consequence and/or remedial procedures can be very costly. The well tools and procedures of this disclosure avoid these kinds of operational risks.

FIG. 1 is a schematic partial cross-sectional view of an example well system 100 that generally includes a substantially cylindrical wellbore 102 extending from a well head (not shown) at a surface 104 downward into the Earth into one or more subterranean zones of interest 106 (one shown). A well string 108 is shown as having been lowered from the surface 104 into the wellbore 102. In certain instances, after some or all of the wellbore 102 is drilled, a portion of the wellbore 102 is lined with lengths of tubing, called casing 110. The casing 110 can make up an outer tubing layer of the well string 108, for example, during a cementing operation. In some instances, the casing 110 includes a series of jointed lengths of tubing coupled together end-to-end and/or a continuous (e.g., not jointed) coiled tubing. In the example well system 100 of FIG. 1, the well string 108 is a work string including cementing well tools 112 (two shown) disposed along a longitudinal length of the well string 108. The number and location of the cementing tools 112 can vary along the longitudinal length, for example, based on well cementing operations, well orientation, and/or other factors. For example, the well string 108 can include one or more cementing well tools 112 disposed at a wellbore location corresponding to a start location of a stage cementing operation.

In the example well system 100 shown, some or all of the wellbore 102 has been drilled, and a first cementing operation has been performed to create a base cement 114 at a downhole location of the wellbore 102. The wellbore 102 can be drilled in stages, and cement with a corresponding casing can be installed between stages. In some implementations, the stage cementing well tools 112 are used to inject cement in stages between the casing 110 and inner walls of the wellbore 102, or between an existing casing and an outer tubular housing of the well tool(s) 112.

Figure 2:
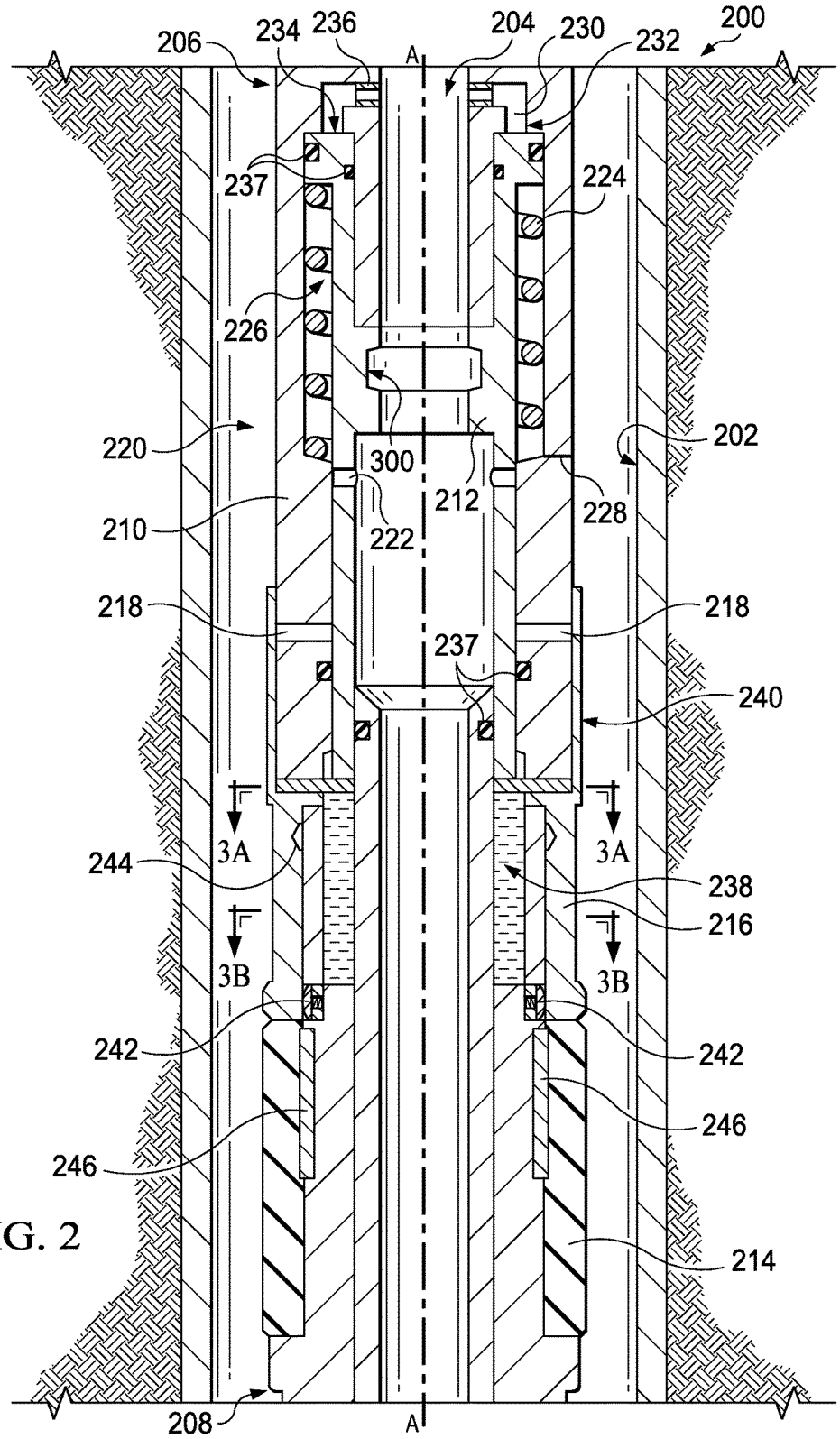
FIG. 2 is a schematic partial cross-sectional view of an example stage cementing well tool in a wellbore.

FIG. 2 is a schematic partial cross-sectional view of an example stage cementing well tool 200 in a wellbore 202. The stage cementing well tool 200 can be used in one of the cementing well tools 112 of the well system 100 of FIG. 1. The example well tool 200 is disposed within the wellbore 202 substantially along longitudinal axis A-A, and includes a central bore 204 extending between an uphole end 206 and a downhole end 208 with respect to the wellbore 202. The example well tool 200 includes a tubular housing 210, a movable inner mandrel 212 disposed within the tubular housing 210, a sealing element 214 circumscribing a portion of the tubular housing 210 proximate the downhole end 208 of the well tool 200, and a movable setting sleeve 216 operable to set the sealing element 214.

Figure 4:
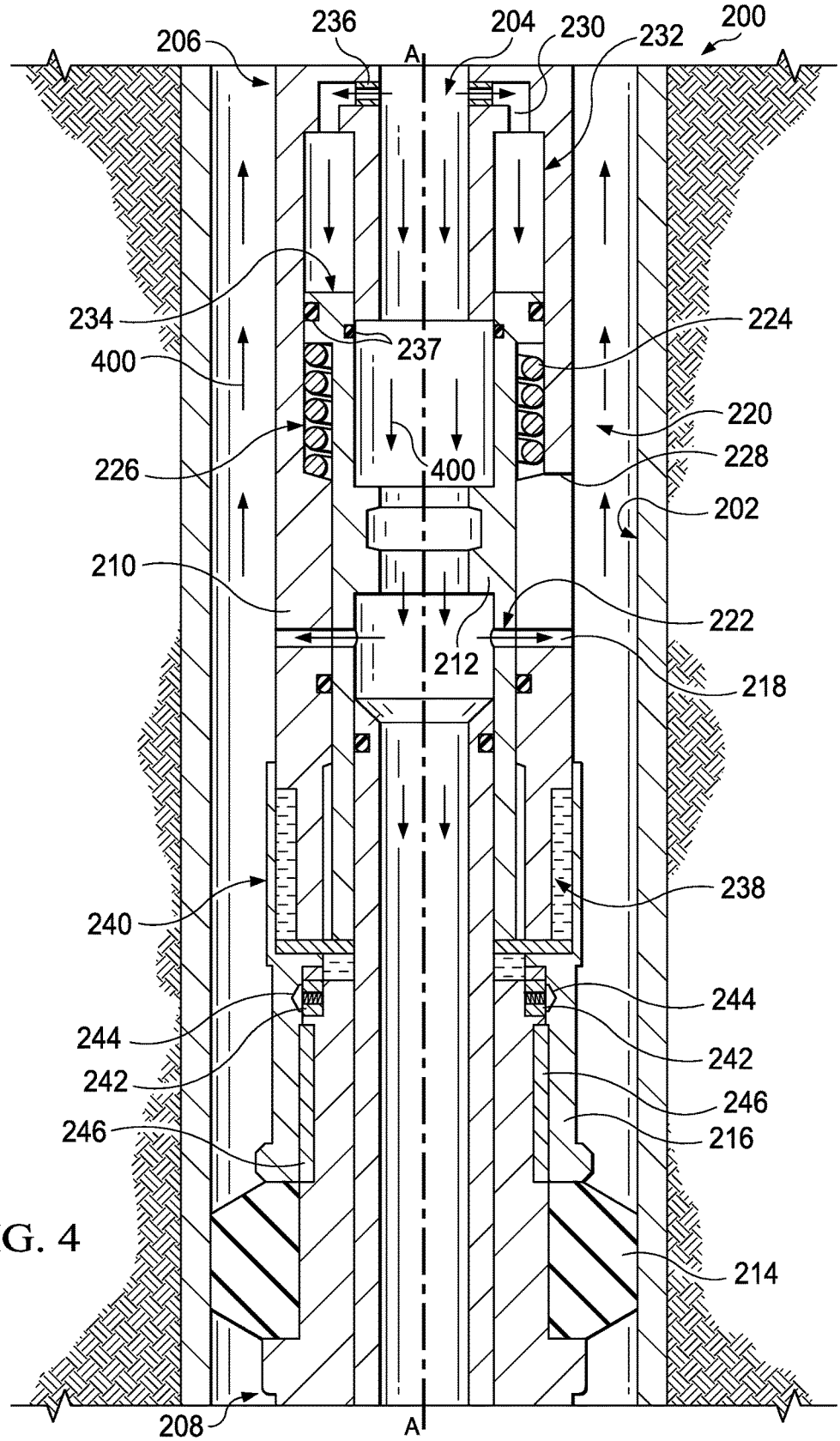
FIG. 4 is a schematic partial cross-sectional view of an example stage cementing well tool in a wellbore.

The inner mandrel 212 is selectively movable between a first, closed position and a second, open position in response to a pressure, such as a fluid pressure (e.g., hydraulic pressure), in the central bore 204 of the well tool 200. The position of the inner mandrel 212 allows for control of fluid flow between the central bore 204 and an annulus 220 between the well tool 200 and the wellbore 202 walls by opening or closing flow ports through the well tool 200 (e.g., between an interior and exterior of the well tool 200). Also, the setting sleeve 216 is movable between a first, retracted position and a second, expanded position in response to movement of the inner mandrel 212. In FIG. 2, the sealing element 214 is shown as a packer element 214; however, the sealing element 214 can take other forms as described below. Movement of the setting sleeve 216 to the second, expanded position sets the packer element 214, for example, to seal against the inner walls of the wellbore 202 to substantially pressure seal the annulus 220. FIG. 2 shows the inner mandrel 212 in the first, closed position and the setting sleeve 216 in the first, retracted position. FIG. 4 is a schematic partial cross-sectional view of the example stage cementing well tool 200 of FIG. 2, where FIG. 4 depicts the inner mandrel 212 in the second, open position, and depicts the setting sleeve in the second, expanded position with the packer element set, for example, in an activated, sealing state.

Referring to both FIGS. 2 and 4, the housing 210 includes a housing port 218 through a wall of the housing 210. The inner mandrel 212 in the first, closed position closes (e.g., plugs, seals, or otherwise blocks) the housing port 218 from fluid flow between the central bore 204 and the annulus 220 between the well tool 200 and the wellbore 202 walls. The inner mandrel 212 also includes a passage 222 through a wall of the inner mandrel 212. The passage is misaligned with the housing port 218 when the inner mandrel 212 is in the first, closed position, as shown in FIG. 2. The passage is aligned with the housing port 218 when the inner mandrel 212 is in the second, open position, as shown in FIG. 4, for example, to allow fluid flow from the central bore 204 out into the annulus 220.

The inner mandrel 212 is substantially tubular, and resides substantially along and partially against an inner surface of the tubular housing 210. In some implementations, a biasing element (e.g., biasing spring 224) between the inner mandrel 212 and the tubular housing 210 biases the inner mandrel 212 toward the first, closed position. In the example well tool 200, the biasing element includes a spring 224 that resides in a spring chamber 226 between a portion of an outer surface of the inner mandrel 212 and an inner surface of the tubular housing 210, where the spring 224 acts on corresponding shoulders of the inner mandrel 212 and tubular housing 210 to bias the inner mandrel 212 toward the first, closed position relative to the tubular housing 210. In certain instances, the tubular housing 210 can include a pressure release vent 228 from the spring chamber 226, for example, to equalize or release pressure in the spring chamber 226 during operation.

The housing 210 includes a fluid inlet port 230 (two shown in FIGS. 2 and 4) fluidly coupling the central bore 204 with a fluid pressure chamber 232 in the tubular housing 210, where a first surface 234 of the inner mandrel 212 is exposed to the fluid pressure chamber 232. The fluid inlet port 230 allows pressure in the central bore 204, such as fluid hydraulic pressure, to act against the first surface 234 of the inner mandrel 212 in a direction parallel to the longitudinal axis A-A. The position of the inner mandrel 212 is based at least in part on a resultant force on the first surface 234 from the central bore pressure and the spring force from the biasing spring 224. The biasing spring 224 acts against the resultant force. For example, below a threshold pressure in the central bore 204, the resultant force is less than the spring force, and the inner mandrel 212 is biased to move to the first, closed position. In some examples, above the threshold pressure of in the central bore 204, the resultant force is greater than the spring force, and the inner mandrel 212 is forced toward the second, open position. In some instances, the inner mandrel 212 and/or the tubular housing 210 includes a stop surface, such as an end surface, shoulder, protrusion, or other element, to hold the inner mandrel 212 in the second, open position such that the passage 222 and the housing port 218 are aligned. In certain instances, the fluid inlet port 230 includes a filter 236, for example, to prevent solids or other contaminants in the central bore 204 from entering the fluid pressure chamber 232. The first surface 234 is shown in FIGS. 2 and 4 as an uphole end of the inner mandrel 212. However, the surface can be a different surface of the inner mandrel 212 that allows fluid pressure from the fluid pressure chamber 232 to act on the inner mandrel 212.

The setting sleeve 216 activates the packer element 214, for example, to set the packer element 214. The setting sleeve 216 is substantially tubular and is movable between a first, retracted position, as shown in FIG. 2, and a second, expanded position, as shown in FIG. 4. Movement of the setting sleeve 216 to the second, expanded position sets the packer element 214. The setting sleeve 216 moves from the first, retracted position in a downhole direction to the second, expanded position in response to movement of the inner mandrel 212 to the second, open position. In the example well tool 200, a fluid (e.g., lubrication fluid, hydraulic fluid, and/or other) in an isolated chamber 238 is pressurized by movement of the inner mandrel 212 toward the second, open position, causing the fluid to act on and move the setting sleeve 216 toward the second, expanded position. For example, the fluid contacts a surface of the inner mandrel 212 about a first end of the isolated fluid chamber 238 and a surface of the setting sleeve 216 about a second end of the isolated fluid chamber 238, and movement of the inner mandrel 212 to the second, open position pressurizes the fluid to move the setting sleeve 216 to the second, engaged position.

The example well tool 200 includes a plurality of seals 237 in the form of O-ring seals between various elements of the well tool 200. The seals 237 act to pressure seal (substantially or completely) surfaces, for example, from fluid penetration between adjacent surfaces of the well tool 200. The seals 237 can take many forms, or can be excluded from the well tool 200.

Figure 3A:
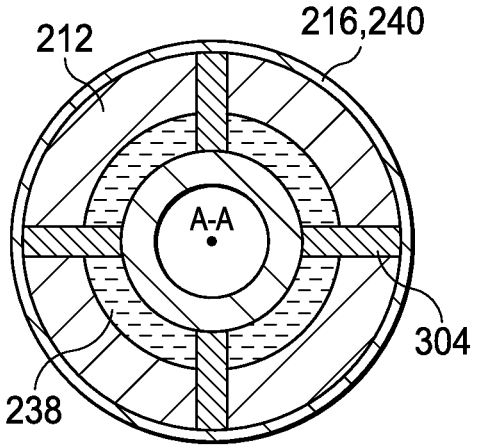
FIGS. 3A and 3B are schematic lateral cross-sectional views of the example stage cementing well tool of FIG. 2.
Figure 3B:
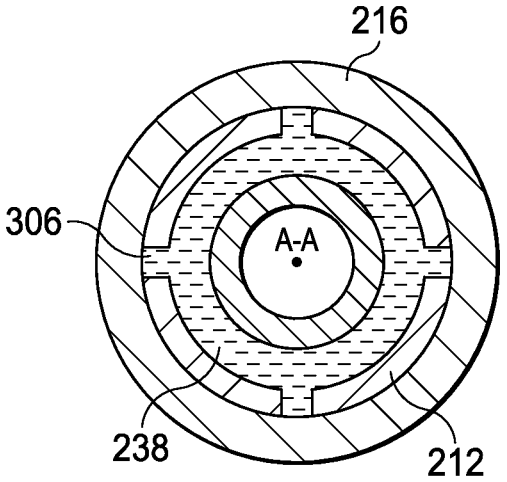

FIGS. 3A and 3B are schematic lateral cross-sectional views of the example stage cementing well tool 200 along cut sections 3A-3A and 3B-3B, respectively, of FIG. 2. In the example well tool 200, the inner mandrel 212 includes a piston head 304 on a downhole end of the inner mandrel 212 that interfaces with the fluid in the isolated chamber 238. FIGS. 3A and 3B represent the inner mandrel 212 in the first, closed position. As the inner mandrel 212 moves toward the second, open position, the fluid in the isolated chamber 238 is pressurized to apply a longitudinal force on an uphole end of the setting sleeve 216 to move the setting sleeve 216. As shown in FIG. 3B, in some instances, the fluid travels through slots 306 in the tubular housing 210 to reach the uphole end of the setting sleeve 216.

The example well tool 200 of FIGS. 2 to 4 shows a hydraulic system (e.g., isolated chamber 238) to actuate the setting sleeve 216. However, actuation of the setting sleeve 216 can be different, such as from direct contact of the inner mandrel 212. For example, a surface of the inner mandrel 212 can (directly or indirectly) contact a surface of the setting sleeve 216 such that the setting sleeve 216 mechanically moves with the inner mandrel 212 due to direct or indirect contact between the inner mandrel 212 and the setting sleeve 216.

In some implementations, the setting sleeve 216 includes a tubular extension 240 that extends upwardly (e.g., in a longitudinally uphole direction) along an outer surface of the tubular housing 210. In the first, retracted position of the setting sleeve 216, the tubular extension 240 covers an outlet end of the housing port 218. Movement of the setting sleeve 216 to the second, expanded position moves the tubular extension 240 downwardly (e.g., in a longitudinally downhole direction) so the outlet end of the housing port 218 is uncovered.

In some implementations, the well tool includes a locking mechanism to lock the setting sleeve 216 in the second, extended position. For example, in the example well tool 200, a spring loaded lock 242 disposed in the tubular housing 210 mates with a recess 244 in the setting sleeve 216 to lock the setting sleeve 216 in the second, extended position.

The packer element 214 of the example well tool 200 is shown as a mechanical packer (e.g., steel wire reinforced elastomer packer), where the mechanical packer is longitudinally compressed by the setting sleeve 216, resulting in lateral extension of the mechanical packer element 214 to seal against walls of the wellbore 202. In other words, the mechanical packer element 214 is extruded, such that it compresses in a longitudinal direction and extends in a lateral direction. In some implementations, the packer element 214 can include another type of packer, such as an inflatable packer, swellable packer, or other. In certain implementations, the well tool 200 includes a grip surface 246, such as a rough surface, anti-slip surface, or other surface, to grip and at least partially hold the setting sleeve 216 in the second, expanded position.

The example well tool 200 of FIGS. 2-4 does not include (e.g., is free from) a plug seat along its longitudinal length. The well tool 200 can include a plug seat along its length, but the plug seat is not needed to actuate movement of the inner mandrel 212 and/or set the packer element 214. The well tool 200 is part of a work string disposed in the wellbore 202, where the work string can include a plug, ball, or other type of seal that pressure seals the central bore 204 at a location of the work string that is downhole of the well tool 200. The example well tool 200 can rely on the downhole seal of the well string to hydraulically actuate the inner mandrel 212, without needing its own dedicated hydraulic seal within the well tool 200 to selectively open and close the flow ports. In other words, the well tool 200 can utilize existing downhole pressure seals in the central bore to hydraulically actuate the inner mandrel 212 of the example well tool 200, for example, to perform stage cementing operations.

In some instances, a diameter of the central bore 204 of the well tool 200 is not obstructed, reduced, or otherwise limited along the longitudinal length of the well tool 200 between its uphole end 206 and downhole end 208. The diameter of the central bore 204 at the uphole end 206 is at least sustained along the length of the well tool 200. In certain instances, the diameter of the central bore 204 varies along the longitudinal length of the well tool 200, but does not decrease at any point along the well tool 200 to a diameter less than the diameter at the uphole end 206.

Figure 5A:
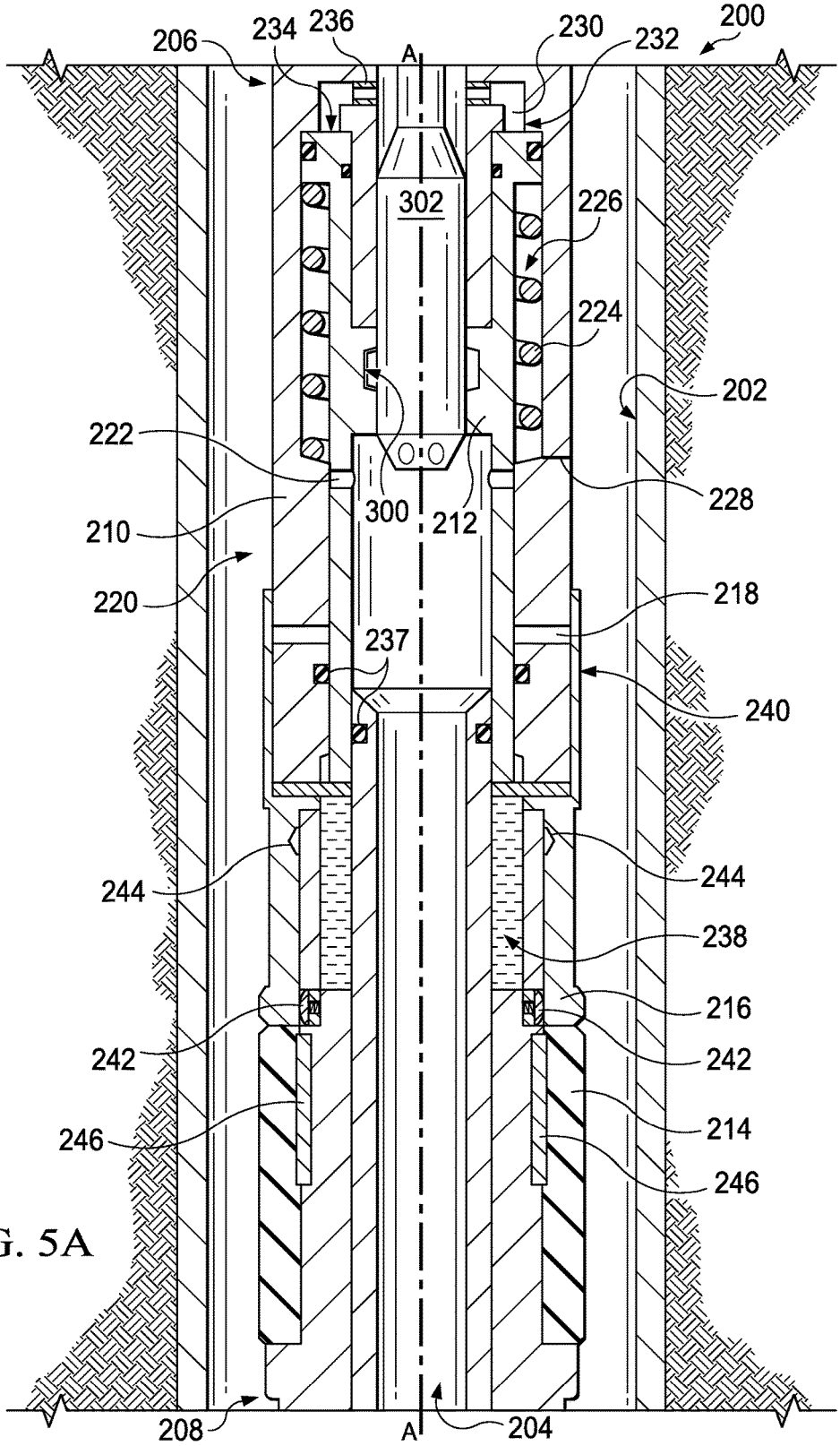
FIGS. 5A and 5B are schematic partial cross-sectional views of an example stage cementing well tool and an example operating tool in a wellbore.
Figure 5B:
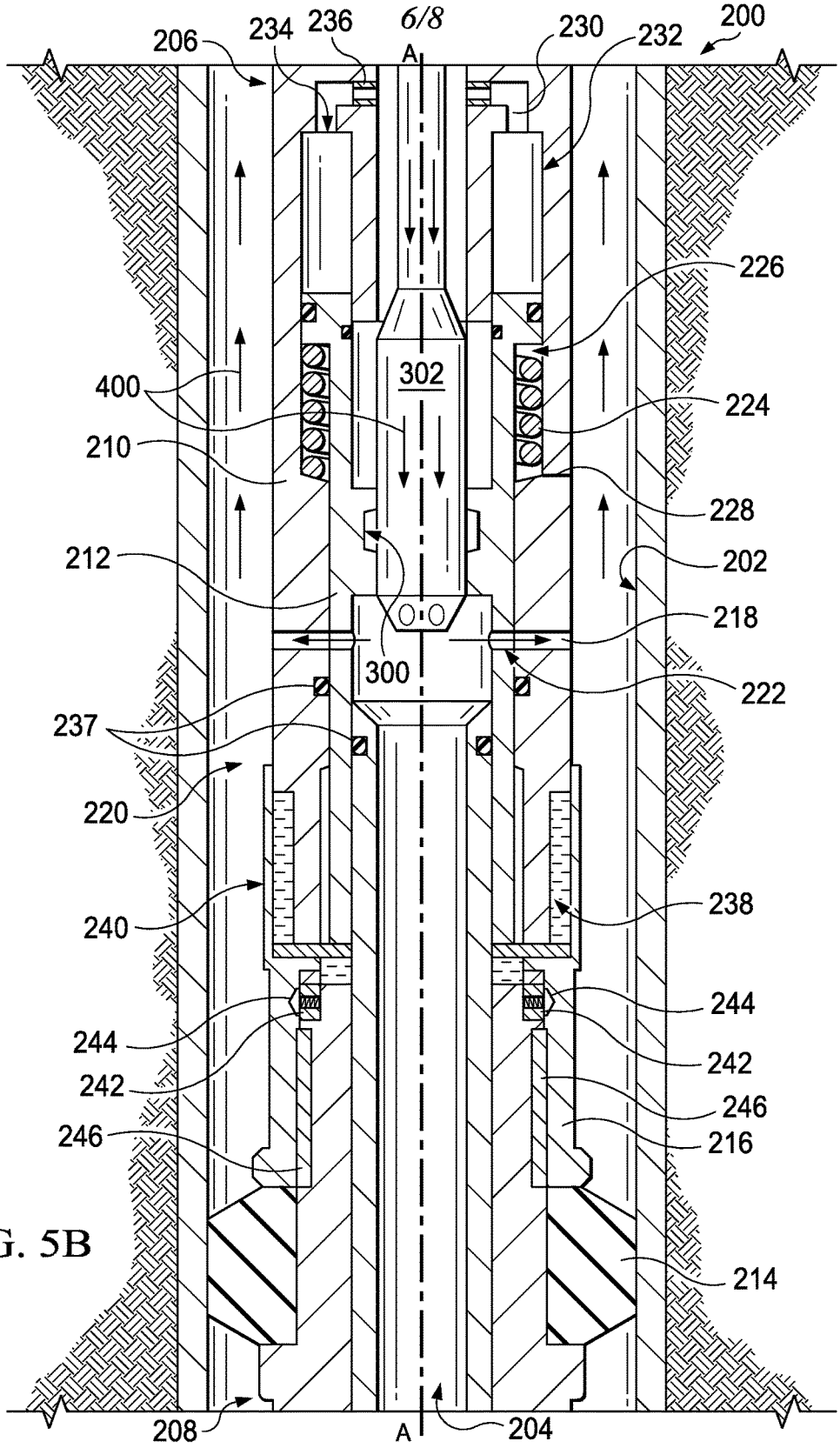

In some implementations, the well tool 200 includes a tool locking profile 300 defined in an inner surface of the inner mandrel 212 that faces the central bore 204. The tool locking profile 300 is configured to engage an operating tool, for example, to mechanically overcome the spring force of the spring 224 and move the inner mandrel 212 to the second, open position. FIGS. 5A and 5B are schematic partial cross-sectional views of the example stage cementing well tool 200 with the tool locking profile 300 engaged with an example operating tool 302. The operating tool 302 includes a tool profile that corresponds with the tool locking profile 300 of the inner mandrel 212. In FIGS. 5A and 5B, the example operating tool 302 includes a ring-shaped radial protrusion that extends into a corresponding ring-shaped recess in the tool locking profile 300 of the inner mandrel 212. This engagement allows a longitudinal force or movement of the operating tool 302 (e.g., slack-off weight of the operating tool 302 acting as a downhole force) to transfer to the inner mandrel 212. The tool locking profile 300 and corresponding tool profile can be different than the example tool profile and tool locking profile 300 shown. For example, the profiles can include interlocking teeth and slots, non-radial protrusions and non-radial recesses, and/or other complementing profile shapes that allow transfer of longitudinal movement (e.g., along longitudinal axis A-A) from the operating tool to the inner mandrel. In some instances, the tool profile of the operating tool 302 is selectively controlled to engage and disengage the inner mandrel 212, for example, by radially retracting or extending a protrusion of the tool profile into a recess of the tool locking profile 300. FIGS. 5A and 5B show the tool profile of the operating tool 302 engaged with the tool locking profile 300 of the inner mandrel 212, where FIG. 5A depicts the inner mandrel 212 in the first, closed position and FIG. 5B depicts the inner mandrel 212 in the second, open position.

In some implementations, the example well tool 200 of FIGS. 2 through 5B may be used in a stage cementing operation in a well. With the central bore of a work string including the example well tool 200 is pressure sealed (e.g., from an engaged plug of a downhole cementing tool), a well operator can pressure-up the central bore of the work string to a desired pressure. In response to a hydraulic pressure in the central bore 204 of the well tool 200 above a threshold hydraulic pressure, the inner mandrel 212 moves from the first, closed position (see FIG. 2) to the second, open position (see FIG. 4). Movement of the inner mandrel 212 to the second, open position moves the setting sleeve 216 from the first, retracted position (see FIG. 2) to the second, expanded position (see FIG. 4). The setting sleeve 216 sets the packer element 214 to seal with walls of the wellbore 202, or an outer casing, thereby sealing the annulus 220 at the location of the packer element 214. With the setting sleeve 216 in the second, expanded position, the packer element 214 and the setting sleeve 216 can be locked in place, for example, by the locking mechanism (e.g., spring-loaded lock 242). In some instances, the packer element 214 can be pressure tested after it is set in the annulus 220. With the inner mandrel 212 in the second, open position, the housing port 218 and the passage 222 in the inner mandrel are aligned to allow cement, concrete slurry, or other fluid to pass from the central bore 204 (or from operating tool 302) through the aligned housing port 218 and passage 222 and into the annulus 220 to fill the annulus 220. In other words, pressure in the central bore 204 is maintained above the threshold hydraulic pressure while cement is pumped down the central bore of the work string to the central bore 204 of the well tool 200. The path of the cement, concrete slurry, or other fluid is depicted in FIGS. 4 and 5B with arrows 400.

Figure 6:
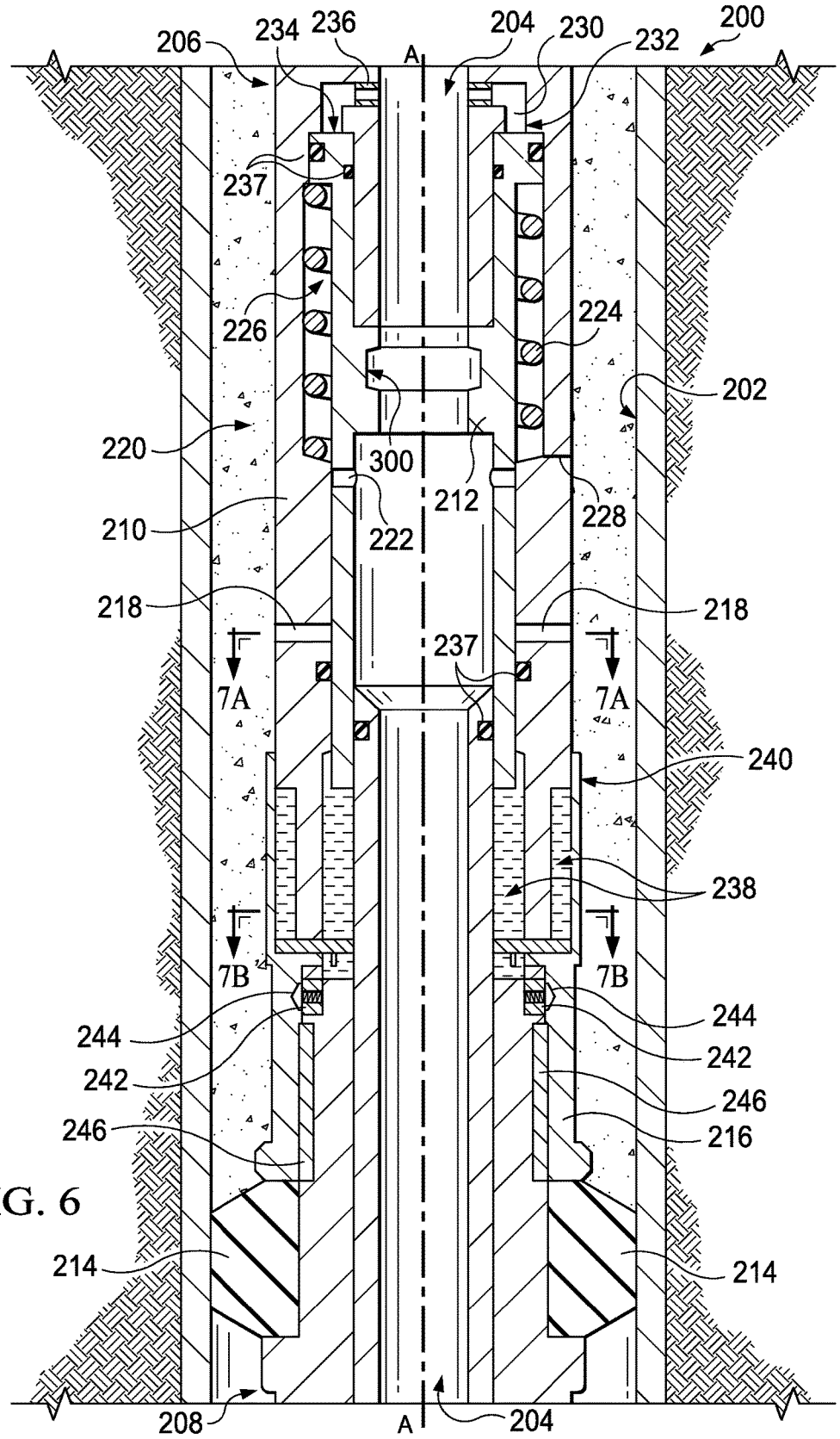
FIG. 6 is a schematic partial cross-sectional view of an example stage cementing well tool in a wellbore.
Figure 7A:
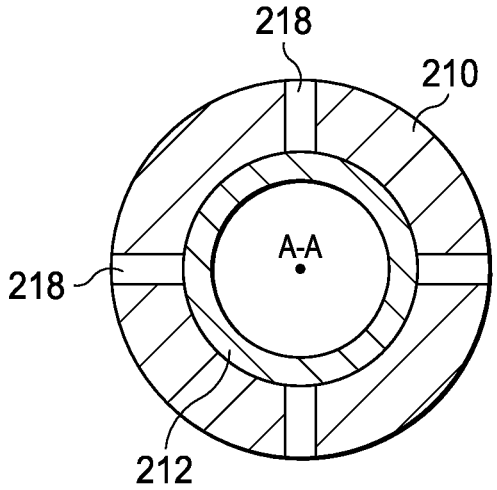
FIGS. 7A and 7B are schematic lateral cross-sectional views of the example stage cementing well tool of FIG. 6.
Figure 7B:
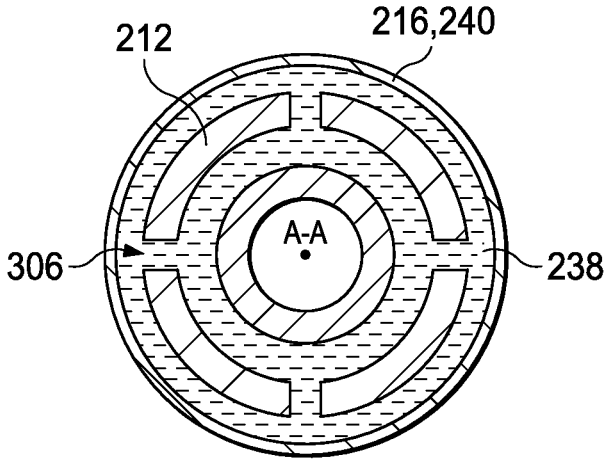

When the stage cementing operation is completed, a pressure in the central bore 204 of the well tool 200 can be decreased (e.g., bleed-off pressure) to a pressure less than the threshold fluid pressure, and the inner mandrel 212 returns to the first, closed position, for example, due to the spring force of the biasing spring 224 or movement of the operating tool 302. FIG. 6 shows the example well tool 200 at this stage during the stage cementing operation, where the inner mandrel 212 has returned to the first, closed position, the setting sleeve 216 remains in the second, expanded position, and the cement, concrete slurry, or other fluid has filled the annulus 220 substantially about the well tool 200 and above the packer element 214. FIGS. 7A and 7B are schematic lateral cross-sectional views of the example stage cementing well tool 200 along cut sections 7A-7A and 7B-7B, respectively, of FIG. 6. FIG. 7A is a lateral cross-sectional view at the location of the housing ports 218, showing the housing ports 218 plugged by the walls of the inner mandrel 212 in the second, closed position. FIG. 7B is a lateral cross-sectional view at the location of the isolated fluid chamber 238, showing the isolated fluid chamber 238 with the inner mandrel 212 in the first, closed position, the setting sleeve 216 in the second, expanded position, and the tubular extension 240 of the setting sleeve 216 maintaining an outer wall of the isolated fluid chamber 238.

A number of implementations have been described. Nevertheless, it will be understood that various modifications may be made without departing from the spirit and scope of the disclosure.

What is claimed is:

1. A well tool for use in completing a wellbore, the well tool comprising:

a tubular housing comprising a central bore and a housing port through a wall of the tubular housing, the central bore comprising a full-bore pass through along an entire longitudinal length of the well tool such that a diameter of the central bore from an entrance of the central bore at an uphole end of the tubular housing to an exit of the central bore at a downhole end of the tubular housing is no less than a diameter of the central bore at the entrance of the central bore;

an inner mandrel disposed within the tubular housing and selectively movable between a first, closed position and a second, open position in response to a fluid pressure in the central bore, the inner mandrel configured to open the housing port when the inner mandrel is in the second, open position;

a sealing element circumscribing a portion of the tubular housing; and a setting sleeve movable between a first, retracted position and a second, expanded position, the setting sleeve configured to activate the sealing element in the second, expanded position in response to movement of the inner mandrel to the second, open position.

2. The well tool of claim 1, further comprising a biasing element between the inner mandrel and the tubular housing to bias the inner mandrel toward the first, closed position.

3. The well tool of claim 1, wherein the inner mandrel comprises a passage through a wall of the inner mandrel, and the passage is alignable with the housing port when the inner mandrel is in the second, open position.

4. The well tool of claim 1, wherein the tubular housing comprises a fluid pressure chamber fluidly coupled to the central bore by a fluid inlet port, and a surface of the inner mandrel contacts a fluid in an interior of the fluid pressure chamber, the inner mandrel configured to move in response to hydraulic pressure of the fluid in the fluid pressure chamber acting on the surface of the inner mandrel.

5. The well tool of claim 4, further comprising a filter disposed in the fluid inlet port.

6. The well tool of claim 1, wherein the inner mandrel comprises a tool locking profile defined in an inner surface of the inner mandrel that faces the central bore, the tool locking profile configured to engage an operating tool.

7. The well tool of claim 1, wherein the central bore is free from a plug seat along a longitudinal length of the well tool.

8. The well tool of claim 1, further comprising a locking mechanism disposed between the tubular housing and the setting sleeve, the locking mechanism configured to lock the setting sleeve in the second, expanded position.

9. The well tool of claim 1, further comprising a fluid in an isolated fluid chamber disposed within the tubular housing, wherein the fluid contacts a surface of the inner mandrel about a first end of the isolated fluid chamber and a surface of the setting sleeve about a second end of the isolated fluid chamber, and movement of the inner mandrel to the second, open position pressurizes the fluid to move the setting sleeve to the second, expanded position.

10. The well tool of claim 1, wherein the sealing element comprises a packer element.

11. The well tool of claim 10, wherein the packer element comprises at least one of a mechanical packer, a swellable packer, or an inflatable packer.

12. A method, comprising:

receiving a fluid pressure greater than a threshold fluid pressure from a central bore of a well tool on an inner mandrel of the well tool, the well tool comprising a tubular housing, the inner mandrel disposed within the tubular housing, a sealing element circumscribing a portion of the tubular housing, and a setting sleeve, the central bore defined by a diameter from an entrance of the central bore at an uphole end of the tubular housing to an exit of the central bore at a downhole end of the tubular housing that is no less than a diameter of the central bore at the entrance of the central bore;

moving, in response to receiving a fluid pressure greater than a threshold fluid pressure, the inner mandrel from a first, closed position to a second, open position;

opening, with the inner mandrel in the second, open position, a housing port through a wall of the tubular housing to fluidly couple the central bore and an exterior of the well tool; and moving, in response to moving the inner mandrel from the first, closed position to the second, open position, the setting sleeve from a first, retracted position to a second, expanded position to activate the sealing element.

13. The method of claim 12, further comprising:

receiving a fluid pressure less than the threshold fluid pressure from the central bore of the well tool; and returning the inner mandrel to the first, closed position.

14. The method of claim 12, wherein returning the inner mandrel to the first, closed position comprises biasing the inner mandrel toward the first, closed position with a biasing spring, where a spring force of the biasing spring acting on the inner mandrel is substantially equal to the threshold fluid pressure.

15. The method of claim 12, wherein the sealing element comprises a packer element, the method further comprising setting the packer element in response to movement of the setting sleeve to the second, expanded position.

16. The method of claim 15, wherein the packer element comprises a mechanical packer, and wherein setting the packer element comprises extruding the mechanical packer to an expanded configuration.

17. The method of claim 12, further comprising locking the setting sleeve in the second, expanded position.

18. The method of claim 12, comprising:

maintaining a fluid pressure in the central bore above the threshold fluid pressure; and pumping cement from within the central bore out of the well tool through the housing port.

19. A stage cementing well tool, comprising:

a tubular housing comprising a central bore and a housing port through a wall of the tubular housing, the central bore having a variable diameter dimension throughout the central bore between an inlet of the central bore and an outlet of the central bore that is no smaller than an inlet diameter of the central bore;

an inner mandrel disposed within the tubular housing and selectively movable between a first, closed position and a second, open position, the inner mandrel comprising a passage through a wall of the inner mandrel, the passage being alignable with the housing port when the inner mandrel is in the second, open position;

a biasing element between the inner mandrel and the tubular housing to bias the inner mandrel in a first direction toward the first, closed position; and a fluid pressure chamber fluidly coupled to a fluid in the central bore, the fluid pressure chamber defined by a surface of the tubular housing and a surface of the inner mandrel, the fluid in an interior of the fluid pressure chamber to apply a hydraulic force on the surface of the inner mandrel in a second, opposite direction toward the second, open position.

* * * * *